US007172522B1

(12) United States Patent
Harvey

(10) Patent No.: US 7,172,522 B1
(45) Date of Patent: Feb. 6, 2007

(54) BASKETBALL TRAINING METHOD

(76) Inventor: Charles David Harvey, 653 Hampton Ct., Sellersburg, IN (US) 47172

( * ) Notice: Subject to any disclaimer, the term of this patent is extended or adjusted under 35 U.S.C. 154(b) by 70 days.

(21) Appl. No.: 10/908,793

(22) Filed: May 26, 2005

Related U.S. Application Data

(60) Provisional application No. 60/626,670, filed on Nov. 10, 2004.

(51) Int. Cl.
*A63B 69/00* (2006.01)

(52) U.S. Cl. ..... 473/450; 482/124

(58) Field of Classification Search ..... 473/450, 473/422, 464, 458, 459; 482/124, 125
See application file for complete search history.

(56) References Cited

U.S. PATENT DOCUMENTS

| | | | | |
|---|---|---|---|---|
| 1,618,273 | A * | 2/1927 | Davidson | 482/124 |
| 3,680,869 | A | 8/1972 | Brady | |
| 4,095,787 | A | 6/1978 | Saferstein | |
| 4,350,338 | A | 9/1982 | May | |
| 4,377,284 | A | 3/1983 | Okerlin | |
| 4,383,685 | A | 5/1983 | Bishop | |
| 5,188,365 | A | 2/1993 | Picard | |
| 5,222,733 | A | 6/1993 | Brunty | |
| 5,228,682 | A | 7/1993 | Wolf | |
| 5,320,342 | A * | 6/1994 | Houck | 473/450 |
| 5,460,385 | A * | 10/1995 | Lazzeroni | 473/464 |
| 5,518,486 | A | 5/1996 | Sheeler | |
| 5,544,877 | A | 8/1996 | Brownell | |
| 5,545,113 | A * | 8/1996 | Bobich | 482/125 |
| 5,647,827 | A * | 7/1997 | Gutkowski et al. | 482/124 |
| 5,704,856 | A | 1/1998 | Morse | |
| 5,716,307 | A * | 2/1998 | Vadher | 482/125 |
| D396,077 | S | 7/1998 | Heine | |
| 5,816,952 | A | 10/1998 | Blevins | |
| 5,865,695 | A | 2/1999 | Mahala et al. | |
| 6,095,936 | A * | 8/2000 | Kirkpatrick et al. | 473/450 |
| 6,203,453 | B1 * | 3/2001 | Coddens | 473/450 |
| 6,283,877 | B1 | 9/2001 | Cook | |
| 6,612,845 | B1 | 9/2003 | Macri | |
| 6,712,722 | B1 | 3/2004 | Mosley | |
| 6,755,755 | B2 * | 6/2004 | Wah Loh | 473/458 |
| 6,875,135 | B2 * | 4/2005 | Tracy, Sr. | 473/438 |

* cited by examiner

*Primary Examiner*—Eugene Kim
*Assistant Examiner*—M. Chambers
(74) *Attorney, Agent, or Firm*—Camoriano and Associates; Theresa Fritz Camorian; John M. Lenczyk

(57) ABSTRACT

A basketball training device and method for teaching the proper technique to shoot a basketball.

10 Claims, 3 Drawing Sheets

BASKETBALL TRAINING METHOD

This application claims priority from U.S. Provisional Application Ser. No. 60/626,670, filed Nov. 10, 2004. This invention relates to a training device and method for teaching the proper technique to shoot a basketball. In particular, it relates to a device that teaches the proper footwork to use while performing a lay-up type shot.

BACKGROUND

The proper technique for performing a left-handed lay-up starts with the basketball player running towards the basket while dribbling the ball. He then stops dribbling and raises the ball in his left (shooting) hand while simultaneously raising his left knee towards his chest. He then jumps towards the basket by pushing off with his right foot, reaches his left hand toward the basket, and releases (or shoots) the ball towards the basket. With a right-handed lay-up, the player raises his right arm and right leg while pushing off the floor with his left foot.

A common problem for beginners, especially younger players, is the tendency to push off the floor with the foot that is on the same side of the body as the hand that is shooting the ball. For instance, a right-handed shooter often feels more comfortable pushing off the floor with his right leg. However, using the foot on the same side of the body as the shooting hand causes the player to have poorer balance and does not allow him to extend as far toward the basket. Therefore, it is important to develop the proper footwork even if it is initially less comfortable to the player.

BRIEF SUMMARY

The embodiments that are shown and described herein are examples of a device used to train a basketball player to use the proper technique while performing a lay-up type basketball shot. The device attaches to the player's shooting arm and to the leg on the same side of the body as the shooting arm-which is the leg the player should raise to properly execute a lay-up. To use the device, the length of the connector strap is adjusted such that the device pulls on the player's leg when the player raises his arm in the shooting motion. When the device pulls on the player's leg, it reminds the player that he should raise that leg instead of the opposite leg. At the same time, the device is unrestrictive enough to allow the player to dribble, pass, and catch the ball unimpeded.

In a preferred embodiment, the leg strap and arm strap are stitched directly to a connector strap, reducing the opportunity for the device to catch on the player or the player's clothing.

DETAILED DESCRIPTION OF THE PREFERRED EMBODIMENT

Figure 1:
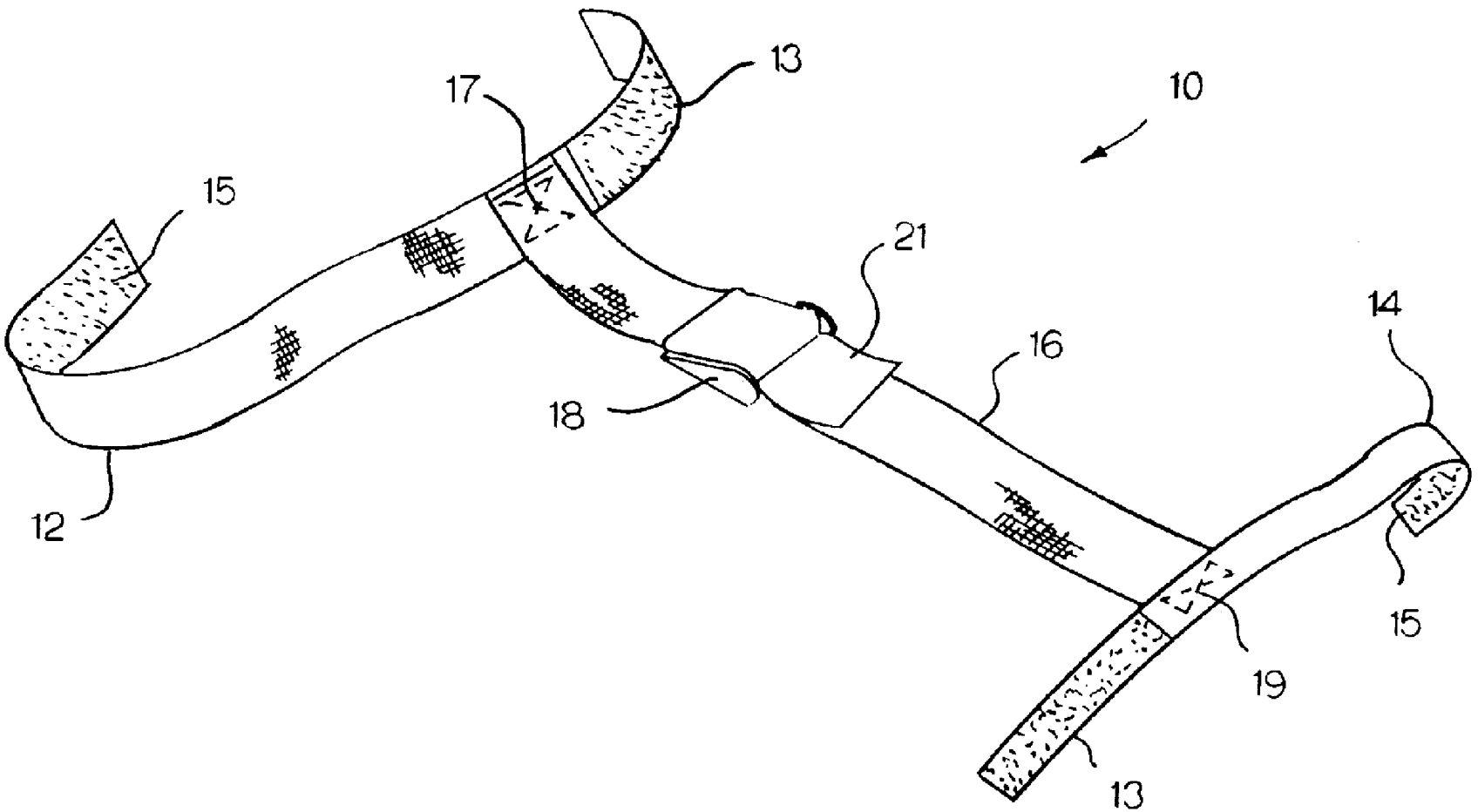
FIG. 1 is a perspective view of a basketball training device made in accordance with the present invention.
Figure 2:
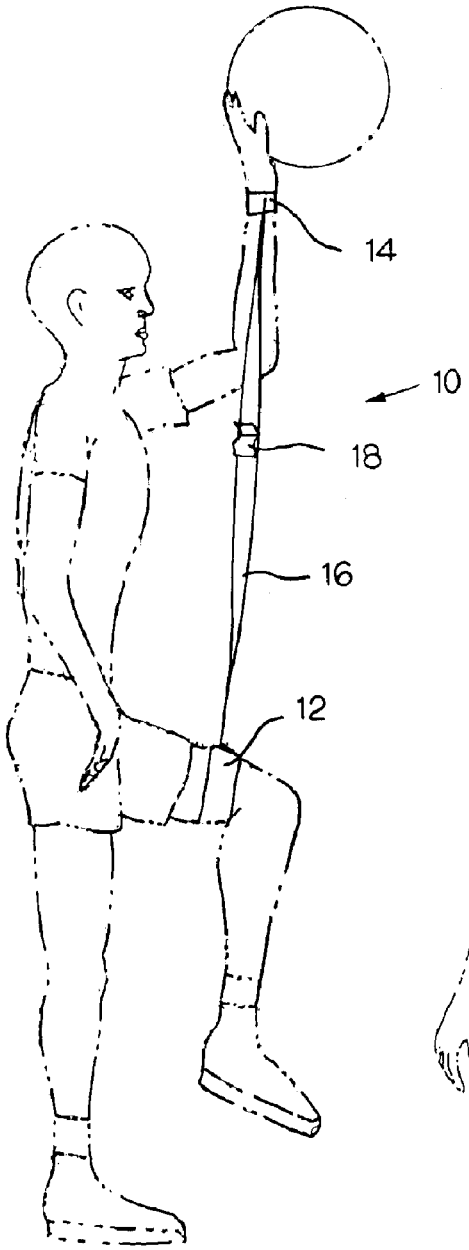
FIG. 2 is a side view of a basketball player wearing the basketball training device of FIG. 1.
Figure 3:
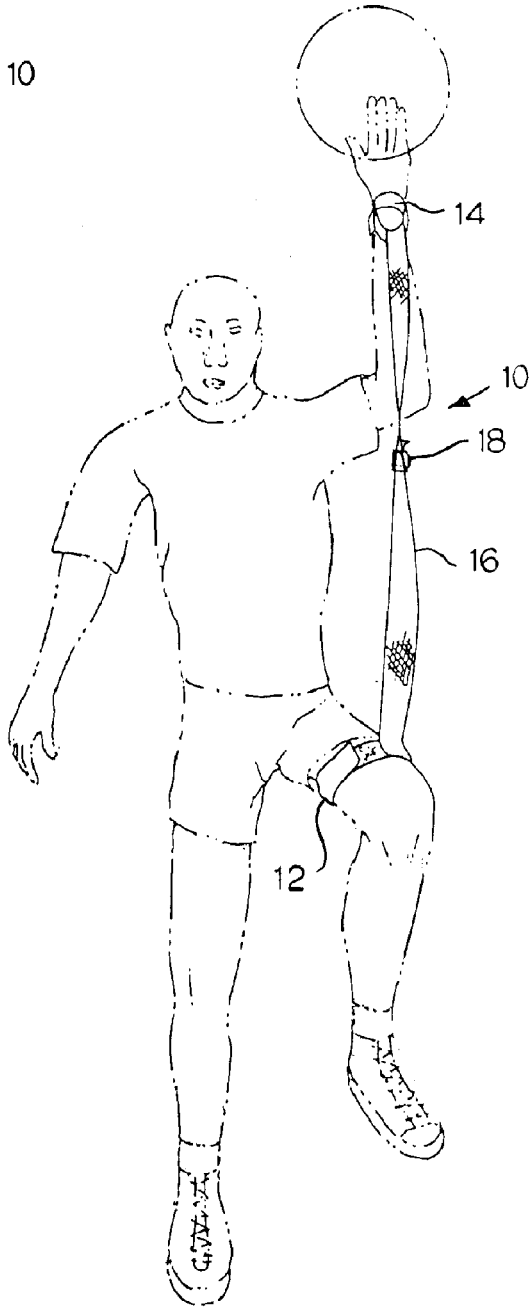
FIG. 3 is a front view of the basketball player of FIG. 2.

FIGS. 1–3 show a basketball training device made in accordance with the present invention. The purpose of this training aid is to teach a basketball player to jump (push off) with the foot on the opposite side of his body from the hand he uses to shoot. So, for example, if he shoots with his left hand, he should push off with his right foot when he shoots, and, if he shoots with his right hand, he should push off with his left foot.

In order to teach this skill, the training device ties together the hand with which the basketball player shoots and the leg on the same side of his body. Thus, when he shoots with his shooting hand, he is pulling up on the leg on the same side of his body, reminding him to raise that leg, and thus causing him to push off with the leg on the opposite side of his body.

Looking at FIG. 1, it can be seen that the training device 10 has three main parts: an adjustable leg strap 12, an adjustable arm strap 14, and a connector strap 16.

The leg strap 12 and arm strap 14 in this embodiment are made of a substantially non-elastic fabric which includes sections of a hook and loop fastener 13, 15, so that the straps are adjustable and can be snugly secured onto a wide range of people, from children to adults. The connector strap 16 has two ends, with one end connected to the leg strap 12 and the other end connected to the arm strap 14. The leg strap 12 in this example is longer than the arm strap 14 and is made of a wider material than the arm strap 14. The ends of the connector strap 16 are stitched directly to the leg strap 12 and arm strap 14 at the points 17, 19, respectively.

Stitching the pieces directly together avoids the need for other attachment mechanisms, such as rings or chains, which are heavier and create potential pinch points or catch points that can catch on the player or his clothing. This device 10 is intended to be used while the player is running and dribbling toward the basket. As a result, it is beneficial for the device to be lightweight and to avoid pinch points or catch points that could catch on the player using the device or on another player who may be playing with the player using the device.

The connector strap 16 is made of an elastic material, and it is made in two pieces connected together by an adjustment lever 18. The connector strap 16 is flat, having a width that is much greater than its thickness. For example, the connector strap 16 may be one inch wide and only 1/16-inch thick. The adjustment lever 18 is similar to the levers used on airplane seatbelts, and it allows the length of the connector strap 16 to be adjusted. When the adjustment lever 18 is flipped open, the free end 21 of the connector strap 16 is freely movable relative to the adjustment lever 18, so the length is easily adjustable. When the adjustment lever 18 is closed, it locks the connector strap 16 in place by means of friction between the adjustment lever 18 and connector strap 16. Other types of quick-adjustment mechanisms are known and could be used instead of the lever 18.

FIGS. 2 and 3 show the training device 10 in use by a basketball player who shoots with his left hand. In this case, the arm strap 14 is secured snugly around the player's left wrist, and the leg strap 12 is secured snugly around his left thigh just above the knee. The arm strap 14 could alternatively be secured elsewhere on the arm, such as near the elbow, and the leg strap 12 could be secured elsewhere on the leg, such as below the knee, if desired. The arm strap 14 and leg strap 12 are connected together by means of the connector strap 16. The length of the connector strap 16 has been adjusted so the player can readily dribble the basketball without interference from the training device 10 but so that, when he raises his arm to shoot the ball, the strap 16 pulls up on his left leg, reminding him to lift his left leg, so he can only jump or push off with the other leg—in this case his right leg.

Of course, the training aid 10 could be used with a right-handed shooter in the same manner, but, in that case, the arm strap 14 would be connected to his right wrist and the leg strap 12 to his right thigh so that, when he goes to shoot with his right hand, the training device pulls up on his right leg, forcing him to jump or push off with his left foot.

Figure 4:
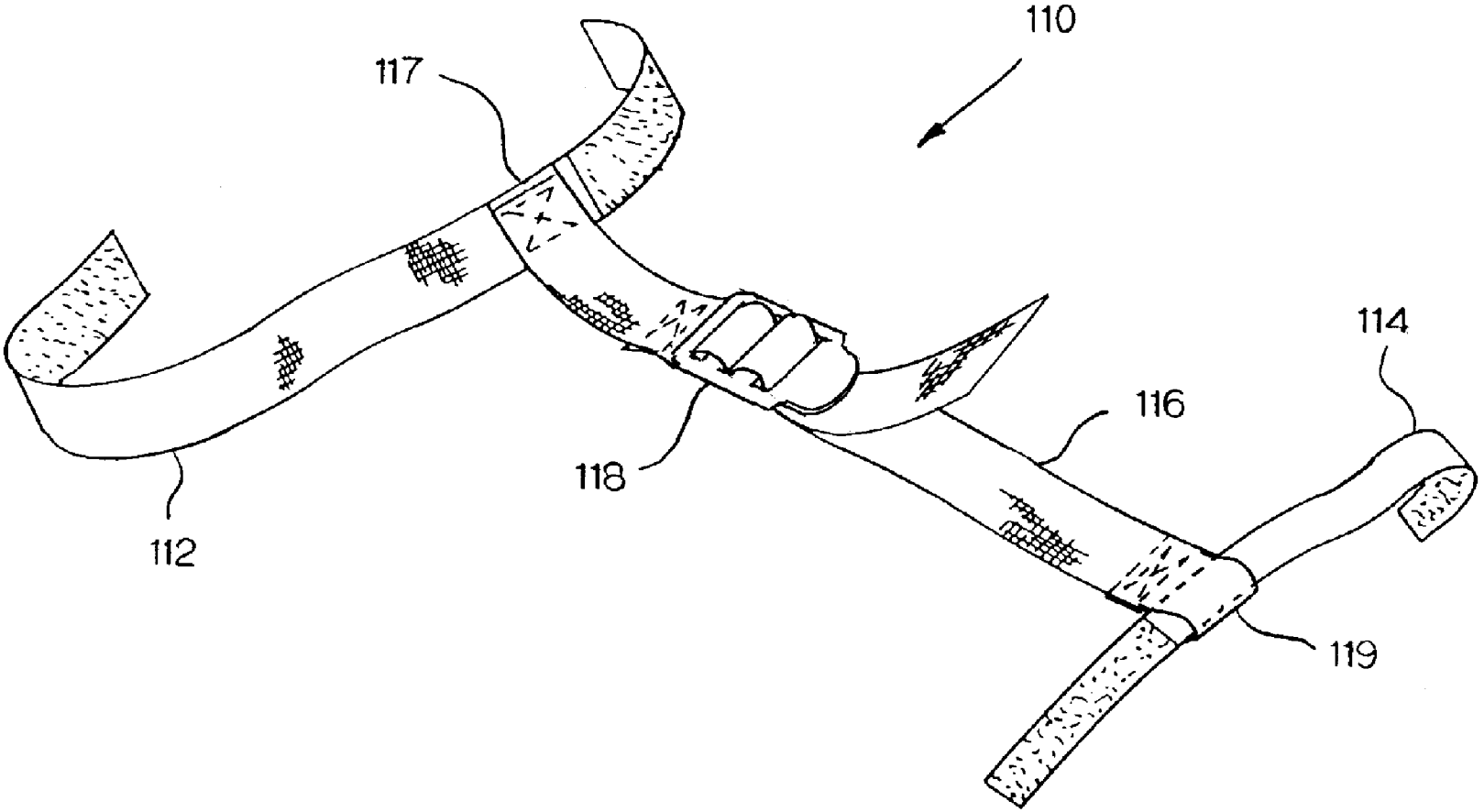
FIG. 4 is perspective view of another embodiment of a basketball training device made in accordance with the present invention

FIG. 4 shows an alternate embodiment of a basketball training device 110 made in accordance with the present invention. The training device 110 has an adjustable leg strap 112, an adjustable arm strap 114, and a connector strap 116. The connector strap 116 is stitched directly to the leg strap 112 at point 117. However, in this embodiment the connector strap 116 is not stitched directly to the arm strap 114. Instead, the connector strap 116 is stitched to itself, creating a loop 119. The arm strap 114 is connected to the connector strap 116 by sliding it through the loop 119.

Also shown in this embodiment is a buckle 118 to adjust the length of the connector strap 116. The connector strap 116 is made in two pieces with the buckle 118 connected to one piece, and the other piece winding through openings in the buckle to allow adjustment of the length of the connector strap 116.

The method of using the training device 110 is exactly the same. The arm strap 114 is secured snugly around a player's shooting wrist, and the leg strap 112 is secured snugly around the player's thigh on the same side of the body as the shooting wrist. The length of the connector strap 116 is adjusted so the player can readily dribble the basketball without interference from the training device 110 but so that, when he raises his arm to shoot the ball, the strap 116 pulls up on his leg, reminding him to lift that leg, so he must put his weight on his other leg—the leg not secured to the training device 110.

It will be obvious to those skilled in the art that modifications may be made to the embodiments described above without departing from the scope of the invention.

What is claimed is:

1. A method of training a basketball player, comprising the steps of:

snugly securing an arm strap to the shooting arm of the basketball player;

snugly securing a leg strap to the leg of the basketball player that is on the same side of the body as the shooting arm;

connecting said arm strap and said leg strap by means of an elastic connector strap; and adjusting said elastic connector strap to a length that is short enough to pull on the leg of said basketball player when he raises his arm in a shooting motion and long enough to allow him to dribble a ball unhindered by said connector strap.

2. A method of training a basketball player as recited in claim 1, wherein said elastic connector strap is made in at least two pieces, one of said pieces being stitched directly to the arm strap and another of the pieces being stitched directly to the leg strap, and further comprising an adjustment lever connecting the pieces together.

3. A method of training a basketball player as recited in claim 1, wherein said elastic connector strap is stitched directly to said arm strap.

4. A method of training a basketball player as recited in claim 3, wherein said elastic connector strap is made in at least two pieces, said pieces being connected together by a means for adjusting the length of said connector strap.

5. A method of training a basketball player as recited in claim 4, wherein said means for adjusting the length of the connector strap is an adjustment lever.

6. A method of training a basketball player as recited in claim 4, wherein said means for adjusting the length of said connector strap is a buckle.

7. A method of training a basketball player as recited in claim 1, wherein said elastic connector strap is stitched directly to said leg strap.

8. A method of training a basketball player as recited in claim 7, wherein said elastic connector strap is made in at least two pieces, said pieces connected together by a means for adjusting the length of said connector strap.

9. A method of training a basketball player as recited in claim 8, wherein said means for adjusting the length of said connector strap is an adjustment lever.

10. A method of training a basketball player as recited in claim 8, wherein said means for adjusting the length of said connector strap is a buckle.

* * * * *